US005267007A

United States Patent [19]

Watanabe et al.

[11] Patent Number: 5,267,007

[45] Date of Patent: Nov. 30, 1993

[54] MAGNETIC SEAL FOR PREVENTING DEVELOPER FROM LEAKING OUT OF THE LONGITUDINAL ENDS OF A ROTATABLE MEMBER

[76] Inventors: Akira Watanabe; Yuji Sakemi; Masahiro Itoh, all of c/o Canon Kabushiki Kaisha 3-30-2 Shimomaruko, Ohta-ku, Tokyo, Japan

[21] Appl. No.: 562,658

[22] Filed: Aug. 3, 1990

[30] Foreign Application Priority Data

| | | | |
|---|---|---|---|
| Aug. 4, 1989 | [JP] | Japan | 1-203505 |
| Dec. 28, 1989 | [JP] | Japan | 10342440 |
| Jan. 12, 1990 | [JP] | Japan | 1-005072 |

[51] Int. Cl.[5] ..... G03G 15/08

[52] U.S. Cl. ..... 355/245; 118/658; 355/215

[58] Field of Search ..... 355/245, 251, 215, 253; 118/657, 653, 658

[56] References Cited

U.S. PATENT DOCUMENTS

| | | | |
|---|---|---|---|
| 3,783,828 | 1/1974 | Forgo et al. | 118/658 |
| 3,788,275 | 1/1974 | Hanson | 118/637 |
| 4,213,617 | 7/1980 | Salger | 355/215 |
| 4,387,664 | 1/1983 | Hosono et al. | 118/658 |
| 4,395,476 | 7/1983 | Kanbe et al. | 430/102 |
| 4,449,810 | 5/1984 | Ikesue et al. | 355/253 |
| 4,563,978 | 1/1986 | Nakamura et al. | 118/658 |
| 4,596,455 | 6/1986 | Kohyama et al. | 355/215 X |
| 4,838,200 | 6/1989 | Hosoi et al. | 118/658 |

FOREIGN PATENT DOCUMENTS

| | | | |
|---|---|---|---|
| 0219233 | 9/1986 | European Pat. Off. . | |
| 56-120819 | 9/1981 | Japan . | |
| 0030859 | 2/1982 | Japan | 355/215 |
| 58-29479 | 2/1983 | Japan . | |
| 60-28673 | 2/1985 | Japan . | |
| 63-124075 | 5/1988 | Japan . | |
| 1-8211 | 2/1989 | Japan . | |
| 2-188292 | 7/1990 | Japan . | |

*Primary Examiner*—A. T. Grimley
*Assistant Examiner*—Nestor R. Ramirez

[57] ABSTRACT

A developing apparatus is provided with a container for containing a developer having magnetic particles. A rotatable member is rotatable in contact with the developer in the container. The rotatable member is supported in the container by a bearing. A magnetic member encloses at least a portion of the rotatable member at a position adjacent to the bearing. The rotatable member comprises a ferromagnetic material disposed at least at a portion facing the magnetic member. The ferromagnetic material is magnetized by the magnetic member, and a magnetic field formed between the magnetic member and the ferromagnetic material forms a magnetic brush of the developer between the magnet member and the rotatable member.

19 Claims, 7 Drawing Sheets

MAGNETIC SEAL FOR PREVENTING DEVELOPER FROM LEAKING OUT OF THE LONGITUDINAL ENDS OF A ROTATABLE MEMBER

FIELD OF THE INVENTION AND RELATED ART

The present invention relates to a developing apparatus for developing an electrostatic latent image formed on an image bearing member through an electrophotographic or electrostatic recording process, more particularly to a developing apparatus using a one component developer mainly comprising magnetic toner or a two component developer comprising magnetic carrier particles and toner particles.

U.S. Pat. No. 4,387,664 or European Patent Application No. 0,219,233A, for example, discloses a developing apparatus provided with a magnetic member extending along a length of a developer carrying member adjacent a developer layer thickness regulating position where the rotatable developer carrying member dispenses the developer toward a developing station. The magnetic member is disposed within the magnetic field provided by a magnet disposed within the developer carrying member to regulate the developer layer into a proper layer thickness.

U.S. Pat. Nos. 4,563,978 and 4,838,200 and European Patent Application No. 0,219,233A, disclose a developing apparatus provided with a magnetic member extending along a length of the developer carrying member at a position where the developer carrying member returns into the container, the developer having passed through the developing position. The magnetic member, too, is disposed within the magnetic field provided by the magnet disposed within the developer carrying member to prevent the developer from moving backwardly from the inlet to the outside.

U.S. Ser. No. 499,729 discloses that the developer is prevented from leaking from opposite longitudinal ends of the developer carrying member to the outside of the container. In this apparatus, ferromagnetic members made of iron or the like are disposed opposed to the longitudinal ends of the developer carrying member to form a magnetic field between the ferromagnetic members and the magnet disposed within a developer carrying member, by which a magnetic brush of the developer is formed. The magnetic brush functions to prevent the developer from leaking through the opposite ends of the developer carrying member.

Within the container for the developer, there is a rotatable member or members such as a screw or a shaft with fins for stirring the developer by the rotation thereof and conveying the developer carrying member in the longitudinal direction, in addition to the developer carrying member. Such a rotatable member or members are supported by bearings in the side walls of the container.

Referring first to FIGS. 1, 2 and 3, the description will be made as to the examples.

In FIG. 1, the shaft, 1 for the rotating member is supported by a bushing 64. In this case, the developer 11 is properly sealed at the initial stage of the use of the developing apparatus. However, with the repeated developing operation, the developer 11 gradually enters the sliding clearance between the shaft 1 and bushing 64 by the pressure of the circulating developer 11, even to such an extent that the developer is fused and fixed there, so that the driving torque is increased. In addition, the sliding surfaces of the shaft 1 and the bushing 64 are worn. Furthermore, the fused toner is agglomerated into a mass. A part of the masses are incorporated in the developer, but if the mass or masses are large, it is stopped by a regulating blade for regulating a thickness of a layer of the developer on the developer carrying member (usually sleeve) to prevent the developer from being applied on the developer carrying member. If this occurs, the resultant image may contain a white stripe.

If the mass is small, it is supplied together with the regular developer with the result of image transfer void around the mass particularly when the solid image is produced, or white dots are formed on the image, thus deteriorating the image quality.

FIG. 2 shows the example of using a ball-bearing 65. This involves the similar drawbacks. Additional drawbacks thereof include the bearing oil leaking from the seal of the bearing 65 which fuses or coagulate, the developer, and the developer and the bearing oil entering the bearing 65 and being fused and fixed, so that the bearing 65 sticks.

FIG. 3 shows an example wherein the use is made with an elastic contact seal (oil seal 66). As compared with the above-described two examples, the developer sealing effect is much better. However, this example involves another problems. In order to assure the sealing effect, the surface property of the shaft 1 contactable to the elastic seal 66 has to be accurately manufactured in order to assure the sealing effect. This increases the manufacturing cost, and with the repeated sliding relative to the shaft results in the wearing and damage at the sliding contact portions. The contact portion may be deformed by the pressure of the circulating developer 11, so that the sealing effect is reduced. If this occurs, the same problems as in the foregoing two examples arise, and the durability is low.

If the close-contactness of the sealing member 66 relative to the shaft 1 is increased in an attempt to solve the above problems, a large stress is applied to the screw rotational shaft with the result of increased motor load for the rotation of the screw shaft. In any case, the toner is rubbed at the portion where the seal 66 and the shaft are in sliding contact, which produces small agglomerations of the toner.

Recently, the printers and the copying machines are desired to produce color images and graphic images. This trend increases the importance of the reproducibility of the halftone image or a solid image. In order to meet the desire requiring very high quality of the images, the size of the developer is decreased, and in order to improve the developing performance, an alternating electric field is formed in the developing station, as disclosed in U.S. Pat. No. 4,395,476 and European Patent Application No. 0,219,233A or the like.

When the size of the toner particles is reduced down to, for example, the average particle size of not more than 10 microns, or when the toner contains polyester resin binder exhibiting a sharp fusing property which is suitable for a full-color image formation, the toner generally tends to be more easily agglomerated. When the alternating electric field is formed, the agglomerated toner is more easily deposited on the image to be developed. Additionally, in the case of the color image formation, the agglomerated developer has become a significant problem against a further increase of the image quality. In the color image formation, plural toner images of different colors are superposed to provide subtle color, and therefore, the defect in even one of the toner images is significantly remarkable in the final color image.

U.S. Pat. No. 3,788,275, Japanese U.M. Application Publication No. 29479/1983 and Japanese Patent Application Publication No. 8211/1989 disclose that the leakage of the developer is prevented by a magnetic brush of the developer. In U.S. Pat. No. 3,788,275, a magnet ring is stationarily disposed faced to a screw groove in a rotatable member. In the U.M. Application Publication, a magnet ring is stationarily disposed faced to the rotational shaft made of non-magnetic or weakly magnetic material. In the Japanese Patent Application Publication 8211/1989, a magnet ring fixed on the container and a magnet ring fixed on a shaft are opposed so that the same magnetic polarities are faced to form a repelling magnetic field therebetween.

However, in the prior art, the sealing performance is still unsatisfactory.

SUMMARY OF THE INVENTION

Accordingly, it is a principal object of the present invention to provide a developing apparatus wherein the developer is prevented from leaking out of the longitudinal ends of a rotatable member without significantly increasing the driving load for a member contacted to the developer and rotating in the container.

It is a further object of the present invention to provide a developing apparatus capable of providing a fine and accurate developed images.

It is a further object of the present invention to provide a developing apparatus suitable for producing a high quality color images.

It is a further object of the present invention to provide a developing apparatus provided with an improved magnetic seal.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preferred embodiments will be described in detail in conjunction with the accompanying drawings.

Figure 1:
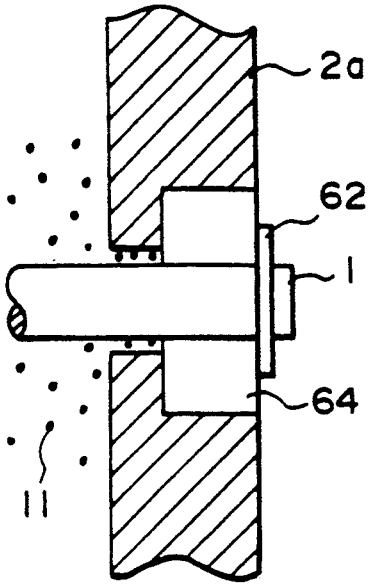
FIG. 1 PRIOR ART
FIG. 1 is a sectional view of an example of prior art.
Figure 2:
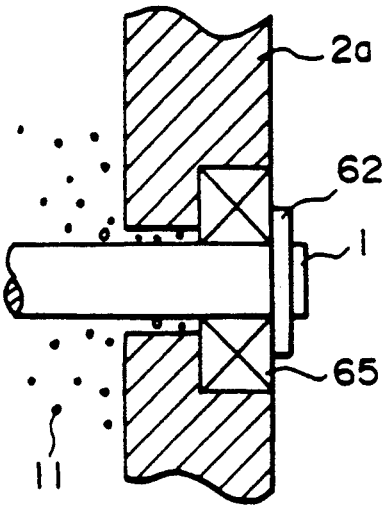
FIG. 2 PRIOR ART
FIG. 2 is a sectional view of another example of prior art.
Figure 3:
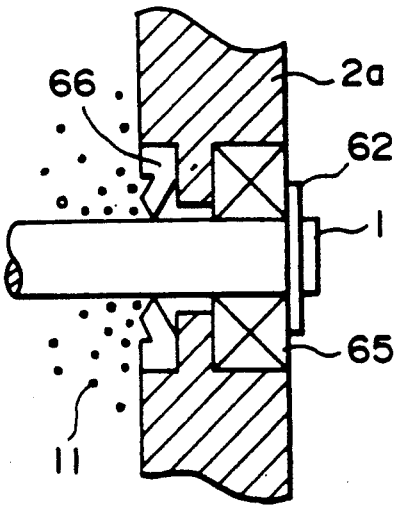
FIG. 3 PRIOR ART
FIG. 3 is a sectional view of a further example of the prior art.
Figure 4:
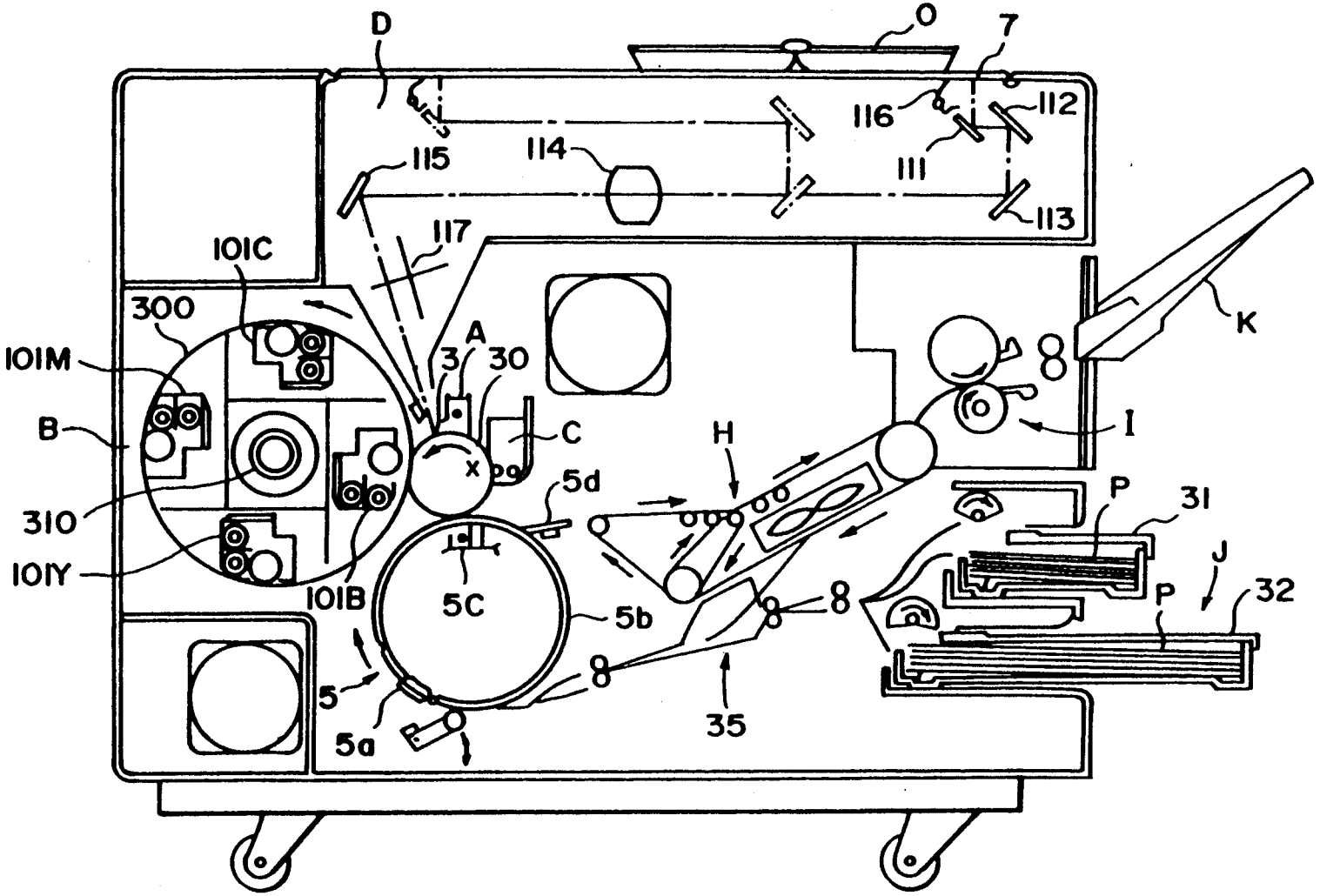
FIG. 4 is a sectional view of a color copying machine to which the present invention is applicable.

Referring to FIG. 4, there is shown a general arrangement of a full color electrophotographic copying machine as an exemplary image forming apparatus to which the present invention is applicable. The copying machine comprises a photosensitive drum 30 (image bearing member) having an electrophotographic photosensitive layer thereon, substantially at the center of the copying machine. It is driven to rotate in a direction indicated by an arrow x.

Substantially right above the photosensitive drum 30, there is a primary charger A, and to the left of the photosensitive drum 30, there is a rotary type developing device B. Substantially right below the photosensitive drum 30, an image transfer device (transfer drum) 5 is disposed. To the right side of the photosensitive drum 30, there is disposed a cleaning device C.

At the to portion of the electrophotographic copying machine, there is an optical system D which functions to project (slit exposure) an image of the original O on a transparent platen 7 (glass platen or the like) onto a photosensitive drum 30 at the exposure station 3 between the primary charger A and the rotary type developing device B.

By the exposure, an electrostatic latent image is formed on the drum 30. As for the optical system D, any known optical system is usable, but in this embodiment, the optical system D comprises a first scanning mirror 111, second and third scanning mirrors 112 and 113 movable in the same direction as the first scanning mirror 111 at a speed which is one half the speed of the first mirror 111, an imaging lens 114 and a fourth stationary mirror 115.

The original illuminating lamp 116 is movable together with the first scanning mirror 111, and the color separation filter 117 is disposed between the fourth stationary mirror 115 and the exposure station 30.

The reflected light image of an original scanned by the first, second and third scanning mirrors 111, 112 and 113 is passed through the lens 114 and is color-separated by a color separation filter 117 through the fourth fixed mirror 115, and is imaged on the photosensitive drum 30 at the exposure station 3.

At a right side of the full color electrophotographic copying machine, there are an image fixing device I and a sheet feeding device J, and transfer material conveying systems 35 are disposed between the image transfer device 5 and the image fixing device I and between the transfer device 5 and the sheet feeding device J.

In this structure, the photosensitive drum 30 is subjected to an image formation process including charging, image exposure, development, image transfer and cleaning by the primary charger A, the optical system D, the rotary type developing device B, the image transfer device 5 and the cleaning device C, for each of the colors into which the color separation filter 117 separates the original image.

The rotary type developing device B comprises a rotatable supporting member 300 and developing devices detachably mounted on the supporting member 300 at substantially 90 degrees intervals. In this embodiment, the developing devices include an yellow developing unit 101Y, a magenta developing device 101M, a cyan developing unit 101C and a black developing unit 101BK, namely, four developing units are mounted. A latent image for one of the separated colors on the photosensitive drum 30 is visualized with a developer in the corresponding developing unit. By controlling the angular position at the interval of 90 degrees of the rotatable supporting member 300, the developing roller of a desired developing unit is moved to a developing position where it is faced to the photosensitive drum 30, so that the developing action is performed by the developing unit. During the developing operation, the developing roller is supplied with a vibratory voltage, as a developing bias voltage, in the form of a sine wave, a rectangular wave or the like. The bias voltage may be an AC voltage or a DC biased AC voltage. By the application of the vibratory voltage, the toner is repeatedly deposited on and released from the photosensitive drum, and the latent image is developed. FIG. 4 shows a black developing unit 101B faced to the photosensitive drum 30. The image visualized in this manner is transferred by the transfer device 5 onto the transfer material P supplied from the sheet feeding device J. Typically, the transfer device 5 includes a transfer drum 5*b* having a gripper 5*a* for gripping the transfer material or sheet P. The transfer device 5 grips the leading end of the transfer material P supplied from a cassette 31 or 32 of the sheet feeding device J through a transfer material conveying system 35, and the transfer drum 5*b* rotates it for the transfer material to receive the color separated visualized images from the photosensitive drum 30. At the image transfer position, a transfer charger 5*c* is disposed within the transfer drum 5*b*.

The transfer material P having sequentially received the toner images, is then released from the gripper 5*a*, and is separated from the transfer drum 5*b* by a separation pawl 5*d*. The transfer material P separated from the transfer drum 5*b* is transported by a transfer material conveying system H to the image fixing device I, where the toner image is heated and fixed on the transfer material P. Thereafter, the transfer material P is discharged onto the tray K.

Figure 5:
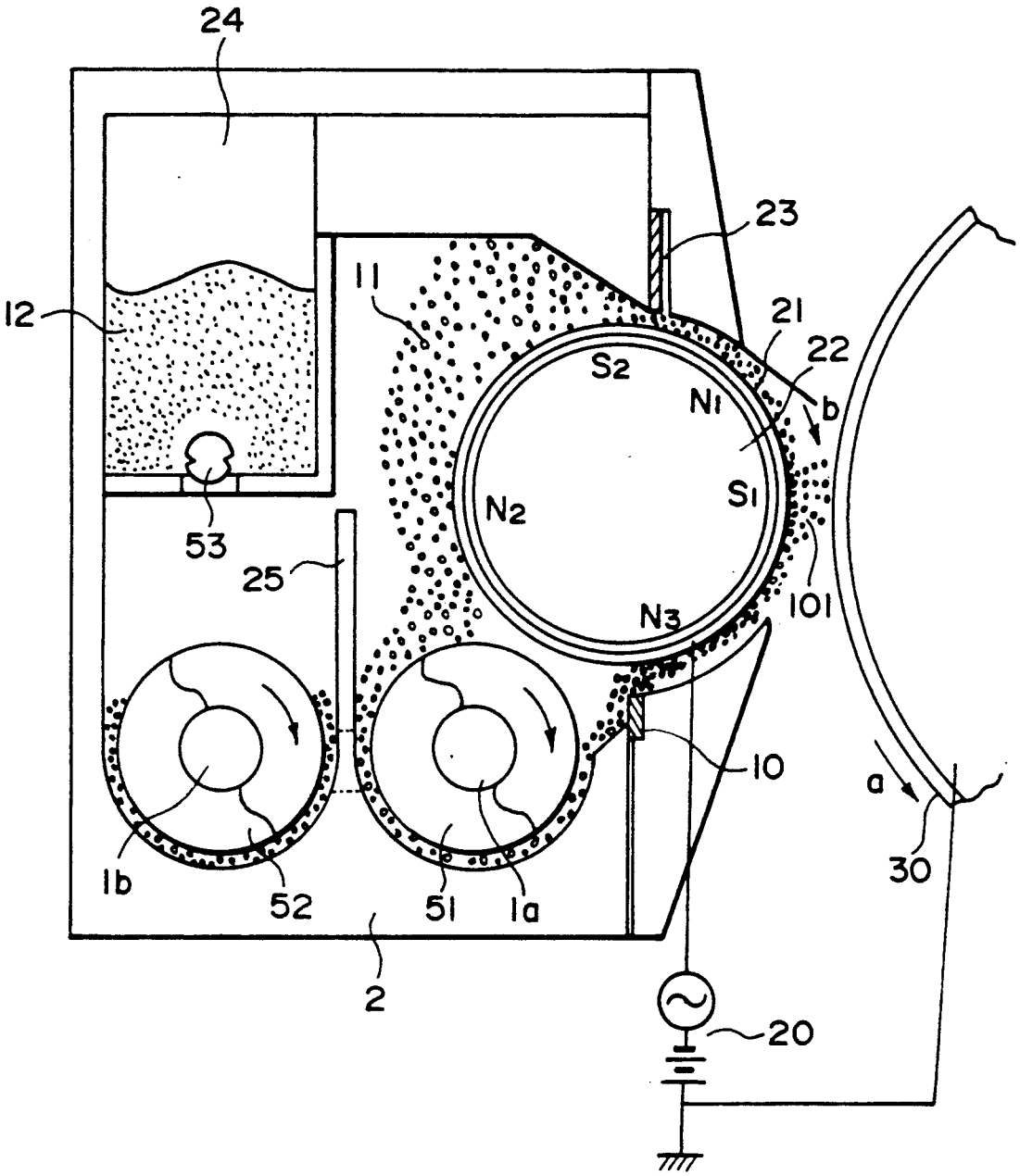
FIG. 5 is a sectional view of a developing apparatus to which the present invention is applicable.

FIG. 5 is a sectional view of one of the developing units of the developing device B shown in FIG. 4. The developing device includes a developer container 2 containing the developer 11. Within the developer container, there is disposed a developing sleeve 21 at an opening of the developer container 2. The developing sleeve 21 is rotatable in a direction b and carries the developer to a developing position 101 where the developing sleeve 21 is faced to the image bearing member 30 to develop the latent image. The sleeve 21 is made of non-magnetic material such as aluminum, non-magnetic stainless steel (SUS 316, for example). Within the sleeve 21, a magnet roller 22 is stationarily disposed.

Above the developing sleeve 21, a blade 23 is mounted on the container 2 with a predetermined gap from the sleeve 21. The blade 23 functions as a developer layer limiting member for limiting the amount of the developer applied on the developing sleeve at the outlet of the container 2. The blade 23 is made of non-magnetic material such as aluminum, non-magnetic stainless steel (SUS 316, for example) or ferromagnetic material such as iron, nickel, cobalt or an alloy of them. By the dimension of the gap between the developing sleeve 21 and the blade 23, the amount, more particularly, the thickness of the developer carried on the developing sleeve 21 to the developing position. Therefore, in this embodiment, the developer comprising the non-magnetic toner and the magnetic carrier particles passes through the clearance between the tip end of the blade 23 and the surface of the developing sleeve 21, and it is supplied to the developing position 101.

Below the developing sleeve 21, that is, at the inlet of the developer into the container 2, a ferromagnetic member 10 is mounted on the container 2 with a predetermined gap from the sleeve 21. The member 10 is effective to form a magnetic field with a magnetic pole N3 of the magnet 22 to prevent the developer from leaking out of the container 2 in a direction opposite to the rotational direction of the sleeve.

The developer, similarly to the prior art, is caught by a magnetic pole N2 is conveyed by the rotation of the developing sleeve 21 to a magnetic pole S2 and to a magnetic pole N1. During the movement, it is regulated by the regulating member 23 into a thin layer of the developer. A developing magnetic pole S1 is effective to form a brush of the developer by the magnetic field thereby. The magnetic brush develops the electrostatic latent image on the image bearing member 30. Subsequently, the developer on the developing sleeve 21 is forced to fall into the developer container 2 by a repelling magnetic field formed between the magnetic poles N3 and N2.

To the sleeve 21, a DC biased AC voltage is applied from the power source 20, by which the an alternating field having alternately changing directions at the developing position. By the alternating electric field, the toner and carrier particles are vibrated, by which the toner particles are released from the confinement by the sleeve and the carrier particles to be deposited on the photosensitive drum 30, corresponding to the latent image.

In the container 2, there are a first rotatable screw 51 and a second rotatable screw 52 to stir the developer D in the developer container 2 and to supply the developer to the developing sleeve 21. The first and second screws 51 and 52 are disposed substantially parallel with a longitudinal direction of the sleeve 21.

The screw 51 receives the developer which has returned into the container 2 through the developing position 101 and released from the sleeve 21 by the repelling magnetic field between the magnetic poles N2 and N3, and stirs the developer and conveys it in the longitudinal direction of the sleeve.

The screw 52 stirs the developer 11 with fresh toner supplied from a toner accommodating chamber 24 by the rotation of a toner supply roller 53, and the screw 51 conveys it in a direction opposite to the developer conveyance direction.

Between the screws 51 and 52, there is a partition wall 25 which is provided with openings adjacent opposite longitudinal ends of the screws. Through the openings, the developer is transferred from the screw 51 to the screw 52, or from the screw 52 to the screw 51. Thus, the developer 11 circulates within the container 2.

The developer stirred by the screws 51 and 52 is taken on the sleeve 21 by the magnetic force of the pole N2 from the neighborhood of the screw 51. The toner in the developer is triboelectrically charged to polarity for developing the latent image by the friction with the carrier particles during the stirring operation.

The developer 11 is a two component developer comprising an insulating and non-magnetic toner particles and the magnetic carrier particles. The non-magnetic toner particles preferably have a weight average particle size of not less than 4 microns and not more than 10 microns. In this embodiment, a color copying machine toner having the weight average particle size of 8 microns is used. In order to provide a sharper color image, it is preferable that not less than 90% by weight of the toner falls within a range of $(\frac{1}{2})M<r<(\frac{3}{2})M$, and not less than 99% by weight falls within the range of $0<r<2M$, where M is the weight average particle size, and r is a particle size of the toner.

The particle size distribution of the toner and the weight average particle size are measured, for example, in the following manner.

The measuring device is Callter Counter TA-II (available from Callter) to which an interface (Nikkaki) and CX-i Personal Computer (available from Canon Kabushiki Kaisha, Japan) for outputting number average distribution and weight average distribution. As for the electrolytic solution, a first class natrium chloride is used to prepare 1% NaCl solution.

The electrolytic solution (100–150 ml) is added with 0.1–5 ml of surface active agent (dispersing agent) (preferably alkylbenzene sulfonate) and further added with 0.5–50 mg of the material to be measured.

The electrolytic solution suspending the material is subjected to the dispersing operation approximately 1–3 min. using an ultrasonic dispersing device. Using TA-II with 100 micron aperture, the particle size distribution for the particles having the particle size of 20–40 microns is obtained. From the distribution, the weight average particle size of the sample material can be obtained.

The toner contains binder resin, coloring agent and additives as desired. It is preferable that hydrophobic colloidal silica fine particles are added to the toner.

Examples of the binder resin materials are styrene-acrylic acid-ester resin, styrene-methacryl acid-ester resin or other styrene copolymer or polyester resin. Particularly when the color mixture in the fixing operation of the toner image by the nonmagnetic color toner in an image forming apparatus, the polyester resin is preferable since it provides a sharp fusing property.

On the other hand, the magnetic carrier particles have a weight average particle size of 30–8 microns, preferably 40–7 microns. In this embodiment, the weight average particle size thereof is 50 microns. The volume resistivity thereof is preferably not less than $10^7$ ohm.cm, preferably not less than $10^8$ ohm.cm, further preferably $10^9$–$10^{12}$ ohm.cm. The carrier particles may be conveniently made of ferrite particles (maximum magnetization of 60 emu/g) or such particles with thin coating of resin material.

The weight average particle size of the carrier particles may be determined in the following manner.

First, the particle size distribution of the carrier is determined in the following steps.

1. Weight of a sample (approximately 100 g) is measured to the order of 0.1 g.

2. Standard screens of 100 mesh, 145 mesh, 200 mesh, 250 mesh, 350 mesh and 400 mesh are stacked with a pan at the bottom. The sample is supplied on the top filter, and it is covered.

3. Then the sample is vibrated by a vibrator at the frequency of 285±6 per minute (in a horizontal plane) and at the frequency of 150±10 (impacts) for 15 minutes.

4. Weights of the screens and the pan are measured to the order of 0.1 g.

5. The weight percentages are calculated to the order of 0.01, and the values are rounded to the order of 0.1 in accordance with JIS-Z 8401.

The frame of the screen has an inside diameter of 200 mm above the screen, and the depth from the screen to the top of the frame is 45 mm.

The total of the weights of the carrier particles must be more than 99% of the original weight of the sample.

The average particle size is determined by the following equation:

Average particle size (micron)=1/100×[(weight on the 100 mesh screen)×149+(weight on the 145 mesh screen)×122+(weight on the 200 mesh screen)×90+(weight on the 250 mesh screen)×68+(weight on the 350 mesh screen)×52+(weight on the 400 mesh screen)×38+(weight having passed through all the screens)×17]

The percentage of the carrier particles less than 500 mesh is determined by placing 50 g sample on a 500 mesh standard screen, and it is sucked from the bottom, and the percentage is calculated by the reduction of the weight.

The volume average of the magnetic carrier particles, for example, ferrite particles or resin coated ferrite particles is determined in the following manner. A sandwich type cell having a measuring electrode area of 4 $cm^2$ and a clearance of 0.4 cm between the electrodes is used. The pressure of 1 kg is applied to one of the electrodes, and a voltage E (V/cm) is applied between the electrodes. The resistance of the magnetic particles is determined from the current through the circuit.

Figure 6:
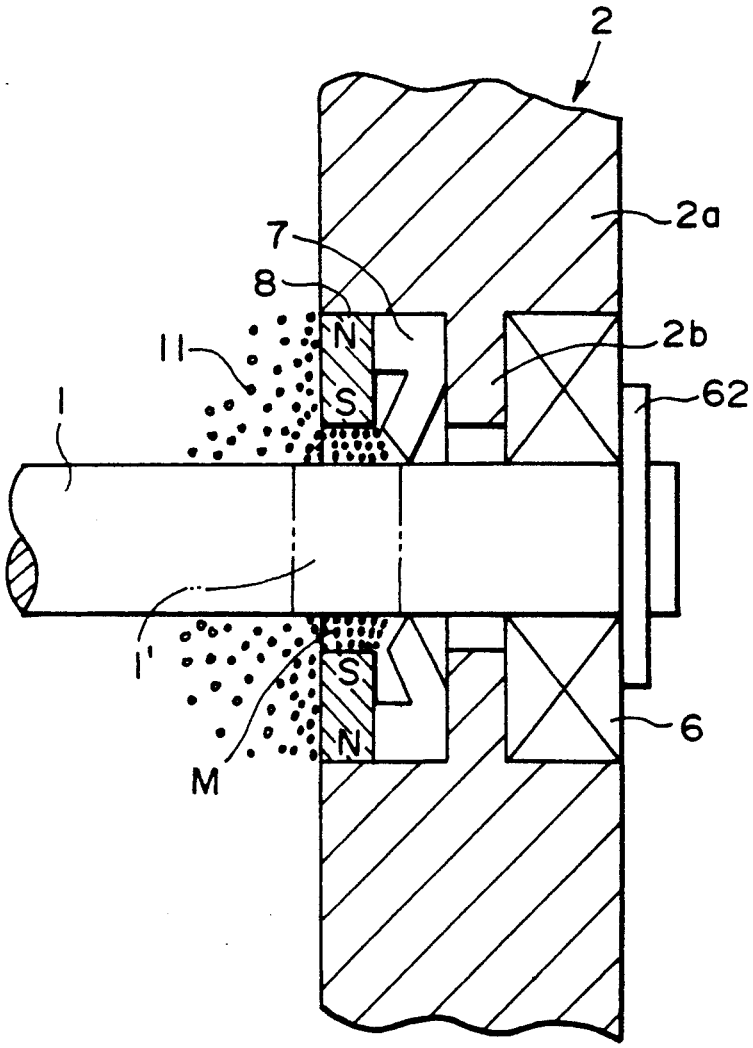
FIG. 6 is a sectional view of a major part of the developing apparatus according to an embodiment of the present invention.

Referring to FIG. 6, the opposite end portions of the shafts 1a and 1b of the first screw 51 and the second screw 52 are rotatably supported on the side walls 2a of the developer container 2 by bearings such as ball-bearings or journal bearings. The thrust movement of the shaft 1 is limited by a stop ring 62. The bearings 6 are fixed on the side walls 2a of the container, the side walls being made of non-magnetic material such as synthetic resin material. FIG. 6 shows only one end of the shaft 1, but it should be understood that the opposite end has the same structure. This applies to the other drawings.

A magnetic ring 8 is disposed at an inside of the bearing 6 with respect to the longitudinal direction of the shaft 1. The magnetic ring 8 is fixed on a side wall 2a of the container. The inside circumference of the magnet ring 8 is faced to the circumferential surface of the shaft 1 through a clearance. The magnet ring 8 is magnetized in a radial direction of the shaft 1. In the figure, the inside of the magnet ring 8 is magnetized to N pole, and shaft is magnetized to S pole. However, the magnetization may be reversed.

The shaft 1 is made of ferromagnetic material such as iron, cobalt, nickel or an alloy thereof. However, from the standpoint of lower cost, the iron is preferable. The ferromagnetic material has the $(\frac{1}{2})$(BH)max of not more than 0.7 $J/m^3$, where (BH)max is the max of B×H, that is, the maximum energy multiple, where B is a residual magnetic flux density, and H is coercive force.

With this structure, the magnetic force by the magnet ring 8 magnetizes the ferromagnetic shaft 1, by which a magnetic circuit is established between the magnet ring 8 and the magnetic rotational shaft 1. Therefore, the magnetic lines of force from the magnetic pole S at the inner circumference tend to erect toward the shaft 1. By this, a high density magnetic brush M of the developer is formed in the clearance between the magnet ring 8 and the ferromagnetic shaft 1.

Most of the magnetic brush M is confined by the magnet ring 8, and therefore, the magnetic brush M is substantially a stationary brush even when the ferromagnetic rotational shaft 1 rotates. Therefore, it is effective to block the developer tending to moving along the ferromagnetic shaft 1 toward the bearing 6. In other words, the magnetic brush M formed with the developer 11 in the clearance between the magnet ring 8 and the ferromagnetic shaft 1 functions as an end seal.

If, in FIG. 6, a contact seal member 7 of elastic material which will be described hereinafter is not used, that is, if only the magnet ring 8 is used, the magnetic brush M is always pressed by the developer 11 by the stirring, circulating and conveying movement of the developer 11 by the rotation of the shaft 1 during the repeated long time developing operation, so that the developer constituting the magnetic brush M gradually leaks toward the bearing 6. Therefore, it is possible that the same problem as with the prior art may arise even though it still has a higher durability than the prior art.

In order to eliminate this drawbacks, too, the FIG. 6 embodiments has an elastic seal member 7 such as an oil seal fixed on a side wall of the container 2*a* at a position between the bearing 6 and magnet 8. The elastic sealing member 7 is contacted to the outer periphery of the shaft 1.

In this embodiment, the bearing 6 and the elastic seal member 7 is partitioned by a partition wall 2*b*, but the wall is not essential.

Thus, an additional seal is provided by the contact between the contact seal member 7 of the elastic material and the surface of the shaft against the developer gradually leaking through the magnetic brush. Therefore, the sealing effect is enhanced, and the durability is improved more.

The pressure by the developer 11 resulting from the stirring, circulation and conveyance of the developer 11 is once stopped by the magnetic brush M formed at the magnetic ring 8, and therefore, the contact between the seal member 7 and the shaft 1 is not urged by the developer at the high pressure, so that the sealing effect by the elastic seal member 7 can be maintained significantly high. The magnetic brush functions as a soft sealing member against the developer, and therefore, the toner is not fused or agglomerated at this position. If a part of the developer gradually leaked through the magnetic brush M is rubbed with the contact seal member 7 at the contact between the shaft and the seal member 7 by the repeated developing operations, and if it results in a fused and agglomerated mass of the developer, the fused and agglomerated mass does not return into the container to appear as a defect on an image, since there is no force for returning the fused and agglomerated mass into the developer container through the magnetic brush M by the magnet ring 8.

When the developing operation is treated without the elastic seal 7 in FIG. 6, the driving torque for the shaft 1 is increased when about 40,000 A4 sheets are processed. When about 45,000 sheets were processed, the developer entering the sliding contact portion and the bearing member 6 is fused and fixed, to an extent that the shaft becomes unrotatable with the result of a damage of a driving gear (not shown) of the shaft 1. However, the resultant image does not involve a defect attributable to a mass of the fused and agglomerated toner.

When the developing operation is repeated with the elastic sealing member 7 (FIG. 6), no image defect due to the fused and agglomerated toner appeared on the image, even after 250,000 sheets were processed. In addition, the driving torque of the shaft 1 is not increased. The developing device is disassembled after a further operation, and it has been confirmed that the sufficient sealing effect is maintained at the contact portion between the sealing member 7 and the shaft 1, and it has also been confirmed that the developer did not leak to the bearing 6. In the foregoing embodiment, the developer 11 has been a two component developer comprising the non-magnetic toner and the magnetic carrier particles. A one component magnetic developer mainly comprising magnetic toner particles having a weight average particle size of 8 microns and containing magnetic powder such as magnetite was used with the apparatus of FIG. 6. Even after 500,000 sheets are processed, the resultant image did not involve any defect contributable to the fused and agglomerated mass. The driving torque for the magnetic shaft 1 was not recognized. Therefore, it is confirmed that the durability is high.

The material of the elastic sealing member 7 is rubber, plastic resin, metal leaf spring or felt.

The further considerations have been made as to the problem that the amount of leakage to the bearing 6 becomes non-negligible with a number of copy operations for a long period of time without the sealing member 7 (FIG. 6), even though the sealing effect is improved over the prior art. It has been found that if the magnetic ring 8 is magnetized in the radial direction of the ring as in FIG. 6, most of the magnetic lines of force from the magnetic pole S adjacent the inner periphery are extended to the magnetic pole N without passage through the body of the ferromagnetic shaft 1. In other words, the degree of concentration of the magnetic force from the magnetic pole S to the shaft 1 is not enough from the standpoint of the further improvement of the sealing effect.

In the following embodiment, the degree of magnetic force concentration from the magnet ring 8 to the ferromagnetic shaft is enhanced, by which the sealing effect by the magnetic brush is further enhanced to eliminate the necessity of the elastic sealing member 7.

Figure 7:
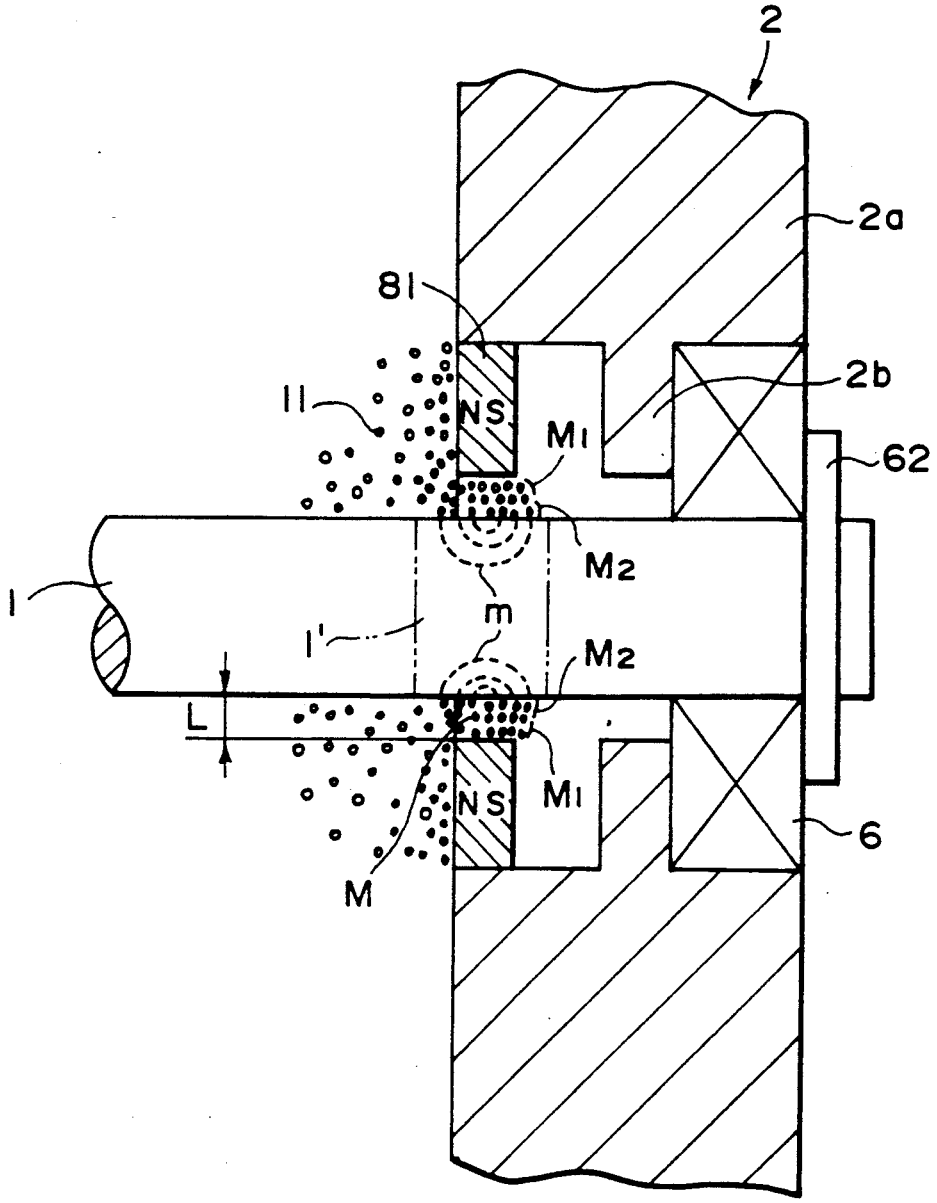
FIG. 7 is a sectional view of the major part of the apparatus according to another embodiment of the present invention.

In FIG. 7, the magnet ring 81 is fixed on the side wall 2*a*, and is magnetized in its thickness direction, that is, in the direction parallel to the longitudinal direction of the ferromagnetic shaft 1. More particularly, in this embodiment, the inside surface facing toward the inside of the developer container 2 is magnetized to the N pole, and the outside surface faced to the bearing 6 is magnetized to the S pole. The polarities may be reversed. In this embodiment, the bearing 6 and the magnet ring 81 is separated by a partition wall 2*b*, but the wall is not inevitable.

By disposing the magnet ring 81 at the opposite end portions of the ferromagnetic rotational shaft 1, the ferromagnetic rotational shaft 1 is magnetized by the magnetic force of the magnet ring 81. Then, a magnetic circuit is established between the magnet ring 81 and the ferromagnetic rotational shaft 1, by which the magnetic field is so concentrated that a high density magnetic brush M is formed in the clearance between the magnet ring 81 and the ferromagnetic shaft 1. In this manner, most of the magnetic lines m of force between the magnetic poles N and S are extended through the body of the ferromagnetic shaft, so that the magnetic field concentration on the ferromagnetic shaft 1 is enhanced, by which the magnetic lines of force erecting to the shaft 1 is increased.

By the strong concentrated magnetic field, the amount of developer confined on the ferromagnetic shaft 1 is increased, and therefore, the magnetic brush M is divided into a portion M1 confined on the magnet ring 81 and a portion M2 confined on the ferromagnetic shaft 1. The brush portion M2 rotates with a part of the brush height is sliced.

Therefore, the magnetic brush portion M2 rotates by the rotation of the shaft 1 inside the substantially stationary magnetic brush portion M1, by which the sealing is established in the clearance between the magnet ring or cylinder and a magnetic shaft 1. Accordingly, the stress applied to the developer 11 is only by the rubbing between the magnetic brush portion M1 and the magnetic brush portion M2, so that it is small. Thus, the problem of the strong stress to the developer by the rubbing between the stationary magnetic brush and a hard shaft as in the above mentioned Japanese Utility Model Application Publication No. 29479/1983, can be formed. In addition, the influence of the surface roughness of the rotation shaft is small, thus assuring the sealing.

The description will be made as to the preferable conditions regarding the shape of the magnetic carrier particles constituting the magnetic brush M, the positional relation between the magnetic rotational shaft 1 and the magnet ring 8 and the magnetic force by the magnet ring 8, when the magnetic shaft 1 is magnetized, and the sealing is assuredly established by the rubbing between the magnetic brush M1 and the magnetic brush M2 confined on the magnetic shaft 1 and the magnet ring 8, respectively.

When the behavior in the rubbing within the magnetic brush M (between the magnetic brush M1 and the magnetic brush M2) is observed, the magnetic brush M mainly comprising the magnetic carrier particles is cut at a certain level of the height of the brush by the rotation of the shaft 1. The carrier particles cut are connected with the neighborhood carrier particles, and then is cut again, by which the clearance between the ferromagnetic shaft 1 and the magnet ring 8 is sealed. There is no rubbing between the magnetic brush M and the ferromagnetic shaft 1, but the carrier particles collide repeatedly, microscopically.

The ordinary developer conventionally used is not significantly influenced by such a stress. However, when the toner, such as the toner containing polyester resin material as the binder is used which has a sharp fusing property, in order to provide full-color image in a color image forming apparatus, the shape of the carrier particles becomes significant. Particularly, if the carrier particles have corner edges, or if they are rubbed with each other at surfaces, a fused material is produced from the toner. It functions as a core to produce agglomeration of the developer, and it is sequentially moves into the developer container and appears as a defect on the resultant image, in some case.

In order to prevent the inconvenience, the shape of the magnetic carrier particles is preferably spherical. In this specification, "spherical" means a shape having no projection and having a ratio between a long axis and the short axis not more than 3.

The inventors' experiments and investigations have revealed that a stabilized sealing effect can be provided for a long period of time when the spherical carrier particles are used.

Since the magnetic brush M effects the sealing operation by repeating the cutting and the connecting, a certain degree of latitude of the magnetic brush M is desired between the ferromagnetic shaft 1 and the magnet ring 8. If the distance between the magnetic shaft 1 and the magnet ring 8 is too small, the possibility of the fused material production increases. A number of experiments and investigations have revealed that the distance L between the outer periphery of the ferromagnetic shaft 1 and the inner periphery of the magnet ring 81, is preferably $L>10d$, further preferably $L\geqq 15d$, where d is a weight average particle size of the carrier. If the distance L is smaller than $10d$, the mobility of the carrier particles are decreased with the result of production of the fused material which leads to a defect on an image in some case. The upper limit of the distance L is determined by one skilled in the art to accomplish the sealing on the basis of the used developer, shaft 1 and the magnet ring 8.

Further, it has been found that the developer leaks to the outside of the sealing, although the amount is very small, after 500,000 sheets are continuously processed. This is because the sealing is effected by repeating the cut and connection between the rotating magnetic brush M2 and the stationary magnetic brush M1. However, this does not result in the production of the fused material or the stick of the bearing 6.

However, since the chains of the carrier particles formed along the magnetic lines of force are cut and then connected, the whirling of the ferromagnetic shaft 1 during the rotation is preferably suppressed. This can be accomplished by increasing the manufacturing accuracy of the bearing 6, and the accuracy in the mounting of the bearing 6 on the side wall 2a. The experiments and investigations have been made as to this problem.

It has been found that $\Delta L<4d$ is preferable, where $\Delta L$ is a maximum variation of the clearance distance L between the ferromagnetic shaft 1 and the magnet ring 8 resulting from the shaft whirling at any position of the magnet ring 81, and d is the weight average particle size of the carrier. If $\Delta L$ is larger than $4d$, a gap appears between the magnetic brush M2 confined on the shaft 1 and the magnetic brush M1 confined on the magnet ring 81, and through the gap, the developer leaks into the space between the magnet ring 81 and the bearing 6 after a long term continuous operation. If this occurs, the space is filled with the developer, which is fused or agglomerated by the bearing oil leaking from the seal of the bearing 6, or the developer in the bearing 6 and the bearing oil are fused and fixed with the result of the bearing 6 stuck. If the whirling of the shaft is large the pressure to the brush is increased at the time when the distance L is small between the ferromagnetic shaft 1 and the magnet ring 81, where the developer is fused with the result of defect on the image. Therefore, the above-described condition of $\Delta L<4d$ is preferable, and under this condition, the stabilized sealing can be provided for a long period.

In this embodiment, the ferromagnetic shaft 1 is magnetized by the magnetic field provided by the ring or cylindrical magnet to effect the sealing against the developer, and therefore, the shaft 1 is desired to be made of ferromagnetic material, and the surface magnetic flux density of the magnet ring is no less than 600 Gauss, preferably.

The experiments have shown that when the magnet ring 81 has the inner diameter of 10 mm and an outer diameter of 13 mm and a thickness of 2 mm, the maximum magnetization energy multiple (B×H)max is required to be 7.0 (MGOe) in order to provide the surface magnetic flux density of not less than 600 Gauss. This condition is satisfied by using a plastic magnet in which rare earth metal alloy powder is bound.

Experiments using the apparatus of FIG. 7 will be described.

Experiment 1

The magnetic ring 81 had the inner diameter of 10 mm, the outer diameter of 13 mm and a thickness of 2 mm and was made of plastic magnet in which $Sm_2CO_{17}$ are bound. The weight average particle size d of the used magnetic carrier was 50 microns, and the diameter of the shaft 1 was 8 mm so as to satisfy $L>10d$ regarding the clearance L between the magnet ring 81 and the shaft 1 made of iron. Namely, L equals to 20*d*.

The maximum variation ΔL in the distance between the rotational shaft 1 and the magnet ring 81 by the whirling of the shaft is suppressed to be not more than 10 microns, and 500,000 A4 sheets were continuously processed.

It was confirmed that the stabilized images were produced without defect on the image. The driving torque for the shaft 1 was not increased, and the developer did not leak to the bearing 6.

Comparison Example 1

The same structure was used with the exception that the maximum variation of ΔL was 250 microns ($\Delta L>4d$). The undesirable image occurred after 20,000 sheets were processed.

Comparison Example 2

The same structure as in the Experiment 1 was used with the exception that the inside diameter of the magnet ring was 9 mm, and the distance between the ferromagnetic rotational shaft 1 and the magnet ring 8 was selected to satisfy $L=10d$. The defect appeared after 10,000 sheets were processed.

Experiment 2

The apparatus used in the Experiment 1 was modified so that the outside diameter of the magnet ring 81 was 14 mm, and the magnet ring 81 had the maximum magnetic energy multiple (B×H)max of 5.0 (MGOe) using a rare earth plastic magnet. The surface magnetic flux density was 800 Gauss.

The same structure was used with the exception that the material and the outer diameter of the magnet ring were changed. The images were free from defect even after 500,000 sheets were continuously processed.

The driving torque for the shaft 1 was not increased, and the developer did not leak to the bearing 6 side.

The same structure as in the Experiment 2 was used with the exception that the inside diameter of the magnet ring was 9.5 mm, and the distance L between the shaft 1 and the magnet ring 8 was set to satisfy $L=15d$. No defect appeared on the image even after 500,000 sheets were processed. The driving torque for the shaft 1 was not increased, and no leakage of the developer to the bearing 6 side was observed.

In the foregoing experiments, the used developer was a two component developer comprising non-magnetic toner particles having a volume average particle size of 8 microns and magnetic carrier particles having a weight average particle size of 50 microns. However, the present invention is not limited to these. The present invention is applicable to a conventional two component developer, a one component magnetic developer or a two component developer having fine particle size and a one component magnetic developer having fine particle size with the advantageous effects.

In the foregoing embodiments, the shaft 1 is made entirely of ferromagnetic material such as iron. However, only a part 1' of the shaft 1 faced to the magnet 8 or 81 may be made of ferromagnetic material such as iron. In this case, a short shaft made of iron or the like is connected with a long shaft or shafts made of non-magnetic material such as stainless steel, or a ring made of ferromagnetic material such as iron is set at the portion 1' of a non-magnetic shaft.

The sealing method for the longitudinal ends of the screw are not limited to those of the embodiment, but may be sealed by a magnetic brush which is formed by concentration of magnetic lines of force on the ferromagnetic shaft by a repelling magnetic field or the like.

The sealing means described above is usable for the longitudinal ends of the shaft of the sleeve 21. However, the leakage prevention at the longitudinal ends of the sleeve may be accomplished by the sealing means disclosed in U.S. Ser. No. 499,729. The sealing means is described in the following.

Figure 8:
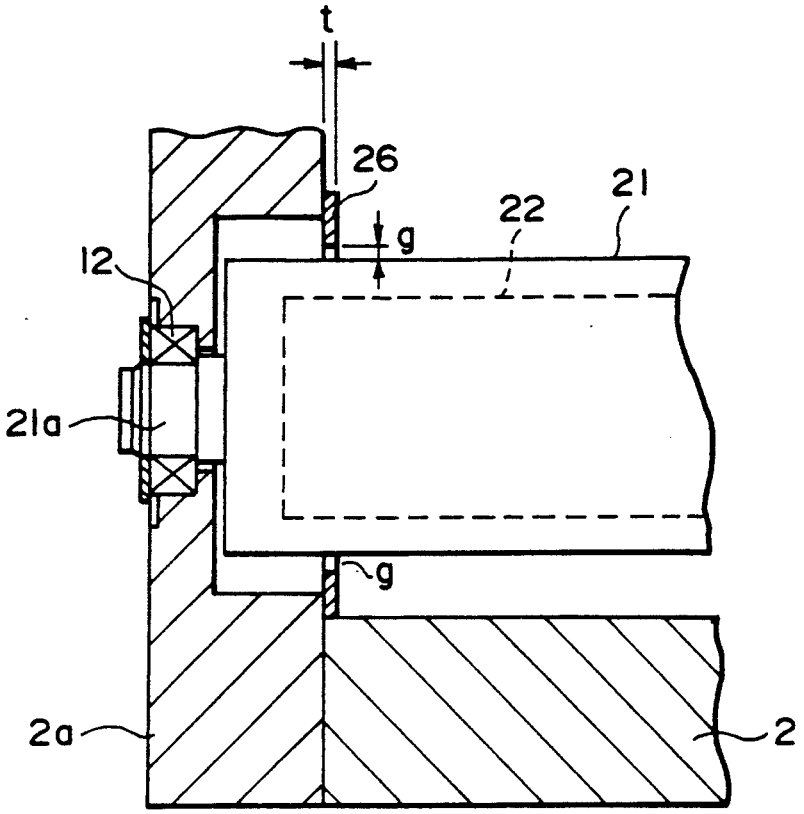
FIG. 8 is a sectional view of a longitudinal end of a sleeve.

Referring to FIG. 8, the developing sleeve 21 has a supporting shaft 21*a* at each of the ends (only one end is shown in FIG. 8), and it is rotatably supported on the side wall 2*a* of the developer container 2 through a bearing 12. The sleeve 21, the screws 51 and 52 are connected through an unshown gear train, and is rotated interrelatedly by a motor.

As shown in FIG. 8, at each of the longitudinal ends of the developing sleeve 21, a plate-like ferromagnetic member 26 is disposed to enclose such a portion of the developing sleeve 21 as is within the container 2, and is fixedly mounted on a side wall 2*a* of the developer container 2. The plate-like ferromagnetic member 26 is provided at each of the longitudinal ends of the sleeve 21, extending along the circumferential direction of the sleeve 21 with a small clearance from the sleeve 21. The ferromagnetic member 22 is within the influence of the magnetic field provided by the magnet 22. In FIG. 8, for example, only one longitudinal end of the sleeve 21 is shown.

The ferromagnetic member 26 is preferably made of ferromagnetic material such as steel, nickel, cobalt or an alloy of two or more of them, having a thickness (t) of 0.2–1 mm. These materials have (½)(BH)max of not more than 0.7 $J/m^3$, where (BH)max is the maximum of B×H, where B is residual magnetic flux density, and H is coercive force, wherein (BH)max is a maximum energy multiple. The gap g between the member 26 and the developing sleeve 21 is not limited, but may be properly selected within the range of 0.3–2 mm.

In this embodiment, the ferromagnetic member 26 has a part annular configuration concentric with the developing sleeve 21 and having a width w to provide a uniform gap g from the developing sleeve 21. However, the configuration may be determined properly by one skilled in the art. It should be noted that the ferromagnetic plate 26 extends along the periphery of the developing sleeve 21 without contact thereto. An angle formed between a side surface of the ferromagnetic plate 26 and a line perpendicular to the circumferential surface of the developing sleeve 21 is preferably not more than 45 degrees in order to assure prevention of the leakage of the developer.

It is preferable that the ferromagnetic plate 26 extends covering the entire circumferential surface of the developing sleeve 21, but it is not inevitable. It may cover that part of the circumferential surface of the developing sleeve 21 which is faced to the position within the container 2.

Figure 9:
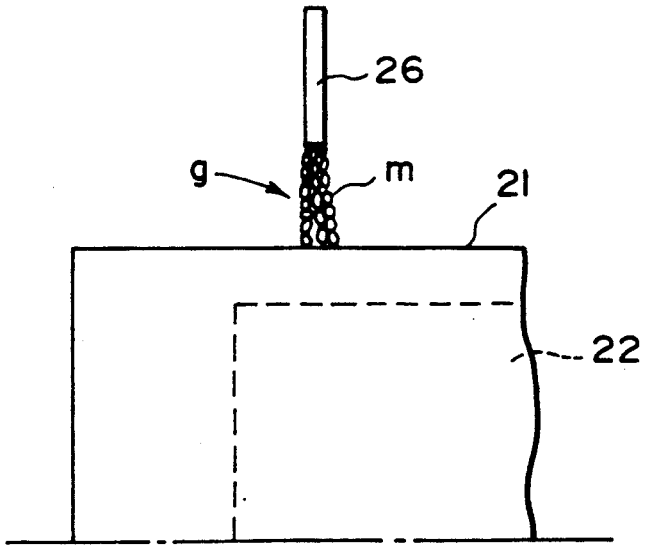
FIG. 9 is an enlarged view of a part of FIG. 8.

By disposing the magnetic plates at the longitudinal opposite end portions of the developing sleeve 21, the ferromagnetic plates 26 is magnetized by the magnetic force of the magnetic roller 22 in the developing sleeve 21, so that a magnetic circuit is established between the magnetic roller 22 and the ferromagnetic plates 26. This is effective to concentrate the magnetic field to the free edge of the magnetic plate 26 adjacent to the developing sleeve 21. Therefore, as shown in FIG. 9, a high density magnetic brush m of the developer particles is formed in the gap g between the ferromagnetic plate 26 and the developing sleeve 21. The magnetic brush m functions to prevent the developer from leaking along the developing sleeve 21 through the clearance between the developer container side wall 2a and the developing sleeve 21 surface into the bearing 12 and to prevent the developer from scattering externally. In other words, the magnetic brush m of the developer formed in the gap g between the ferromagnetic plate 26 and the developing sleeve 21, functions as an end seal (where the developer is the two component developer, the brush m is a magnetic brush of the magnetic carrier particles; and where it is a one component developer, the magnetic brush m is the brush of the magnetic toner).

Figure 10:
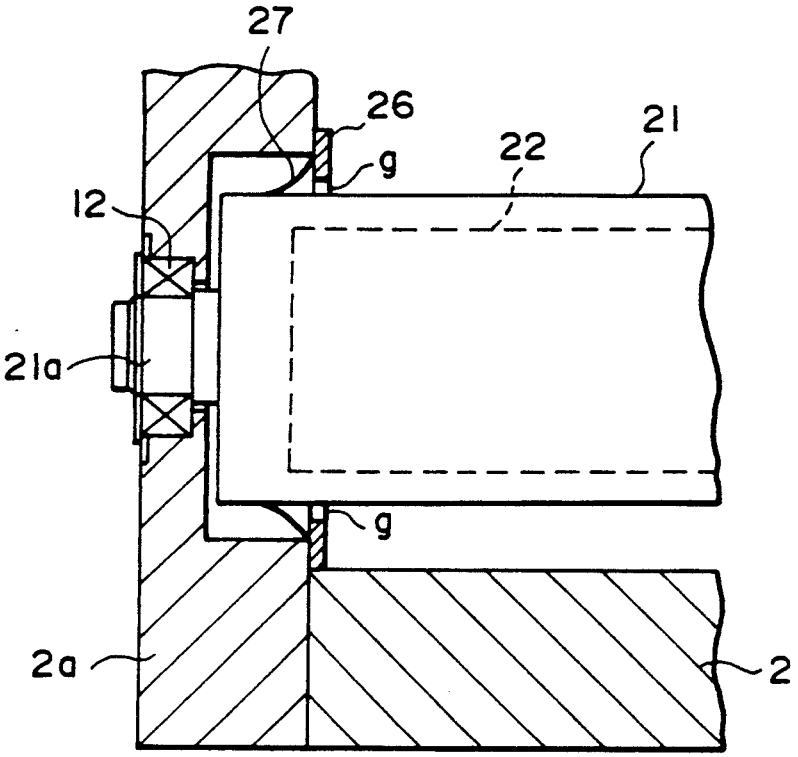
FIG. 10 illustrates another example of the end of the sleeve.

Referring to FIG. 10, another example will be described. In this embodiment, an auxiliary sealing member 27 is disposed adjacent to the ferromagnetic plate 26. The auxiliary sealing member 27 is made of an elastic sheet having an inside edge resiliently contacted to the developing sleeve 21 at a position between the ferromagnetic plate 26 and the bearing 12, while the elastic sheet being bent. A preferable example of the auxiliary sealing member 27 is made of polyethylene terephthalate, urethane rubber sheet or the like having a thickness of 0.1–0.5 mm, for example. By the provision of the auxiliary sealing member 27, it can be avoided that a part of the magnetic brush formed in the gap between the ferromagnetic plate 26 and the developing sleeve 21 scatters toward the bearing 12 with further certainty. The auxiliary sealing member 27 is preferably extended circumferentially within the range in which the ferromagnetic plate 26 circumferentially extends.

Figure 11:
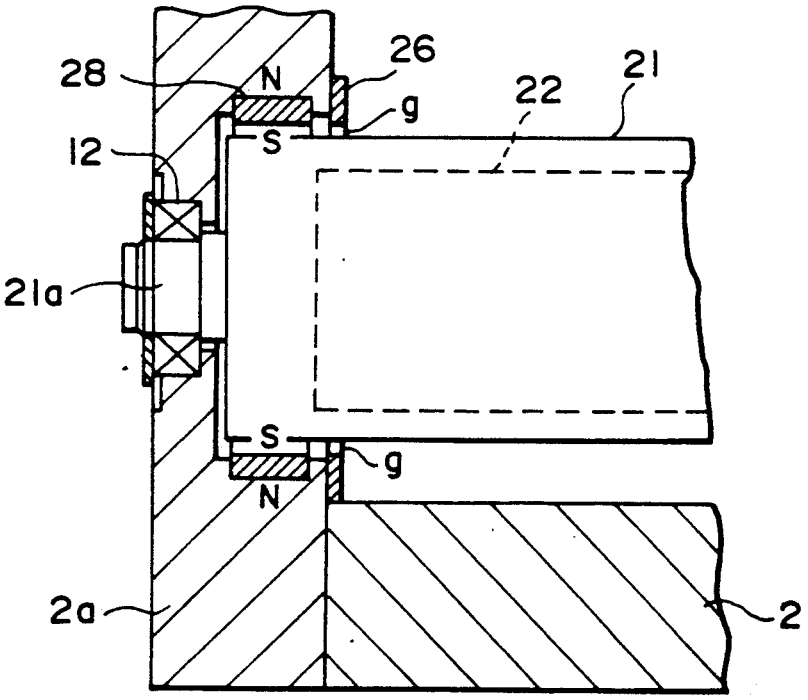
FIG. 11 illustrates another example of the end of the sleeve.

Referring to FIG. 11, a further example will be described. The number and arrangement of the magnetic poles of the magnet roller 22 are not limited to those shown in FIG. 5. If the number and arrangement of FIG. 5 are used, the formation of the magnetic brush of the developer is not so strong in the portion of the gap g adjacent to the portion where the repelling magnetic field is formed by the poles N3 an N2 as the other portions. Therefore, if the developer moves toward the bearing 12 through the portion of the gap g, the developer is caught by a magnet 28 which is an alternative of the auxiliary sealing member. The magnet 28 is a part annular permanent magnet extending along the peripheral surface of the developing sleeve 21 in the region where the ferromagnetic plate 26 exists, at a longitudinal position between the ferromagnetic plate 26 and the bearing 12. The part annular magnet may be a rubber magnet containing magnetic powder dispersed therein or a plastic magnet or the like.

In this embodiment, the inside surface of the part annular magnet is magnetized to S polarity, and the outer surface side is magnetized to N polarity. It is particularly effective to prevent the leakage of the developer through the region where the repelling magnetic field is formed by the magnetic poles N3 and N2. According to this embodiment, the developer once caught by the magnet 28 is formed into a magnetic brush in the gap between the magnet 28 and the developing sleeve 21 surface, and thereafter, the magnetic brush functions to seal the developer against the possible leakage in the region where the repelling magnetic field is formed by the magnetic poles N3 and N2.

By magnetically preventing the leakage of the developer using the magnet 22 within the sleeve, at the opposite longitudinal ends of the sleeve 21, the production of fused agglomeration of the developer can be further prevented.

While the invention has been described wit reference to the structures disclosed herein, it is not confined to the details set forth and this application is intended to cover such modifications or changes as may come within the purposes of the improvements or the scope of the following claims.

What is claimed is:

1. A developing apparatus, comprising:

a container for containing a developer comprising magnetic particles;

a rotatable member rotatable in said container in contact with the developer, said rotatable member comprising a portion for stirring the developer, and being supported in said container by a bearing;

a developer carrying member for carrying the developer stirred by said rotatable member to a developing zone for developing an electrostatic latent image;

magnet means stationarily disposed inside of said developer carrying member;

a magnet member enclosing at least a part of said rotatable member at a position adjacent to the bearing, said magnet member being fixed on said container, and said magnet member being magnetized in a longitudinal direction of said rotatable member;

wherein said rotatable member comprises a ferromagnetic material at least at a position facing said magnet member, wherein the ferromagnetic material is magnetized by said magnet member, wherein a magnetic field formed between said magnet member and the ferromagnetic material forms a magnetic brush of the developer between the magnet member and said rotatable member, and wherein the magnetic brush comprises a rotatable portion supported on said rotatable member and rotating in according with rotation of said rotatable member and a substantially stationary portion supported and confined by said magnet member.

2. An apparatus according to claim 1, wherein the developer comprises toner particles having an average particle size of 4–10 microns and magnetic carrier particles having an average particle size of 30–80 microns.

3. An apparatus according to any one of claims 1 or 2, further comprising a voltage source for applying to said developer carrying member a bias voltage for forming an alternating electric field in the developing zone.

4. An apparatus according to any one of claims 1 or 2, wherein a clearance between said magnet member and said rotatable member is larger than 10 times an average particle size of the magnetic carrier particles.

5. An apparatus according to claim 1, wherein said magnet member provides a surface magnetic flux density of at least 600 Gauss.

6. A developing apparatus, comprising:

a container for accommodating a developer comprising magnetic particles;

a rotatable member rotatable in said container in contact with the developer, said rotatable member being supported in said container by a bearing; and a magnet member enclosing at least a part of said rotatable member at a position adjacent to the bearing, said magnet member being fixed on said container;

wherein said rotatable member comprises a ferromagnetic material at least at a position facing said magnet member, wherein the ferromagnetic material is magnetized by said magnet member, wherein a magnetic field formed between said magnet member and the ferromagnetic materials forms a magnetic brush of the developer between the magnet member and said rotatable member, and wherein said magnetic brush includes a rotatable portion supported on said rotatable member and rotating in accordance with rotation of said rotatable member and a substantially stationary portion supported and confined by said magnet member.

7. An apparatus according to claim 6, wherein said magnet member provides a surface magnetic flux density of at least 600 Gauss.

8. An apparatus according to claim 6, wherein said rotatable member comprises a portion for stirring the developer, and wherein said apparatus further comprises a developer carrying member for carrying the developer stirred by said rotatable member to a developing zone for developing an electrostatic latent image and magnet means stationarily disposed inside of said developer carrying member.

9. An apparatus according to claim 6 wherein the developer comprises toner particles having an average particle size of 4–10 microns and magnetic carrier particles having an average particle size of 30–80 microns.

10. An apparatus according to claim 8 or 9, wherein a clearance between said magnet member and said rotatable member is larger than 10 times an average particle size of the magnetic carrier particles.

11. An apparatus according to claim 8, wherein said magnet member is magnetized in a longitudinal direction of said rotatable member.

12. An apparatus according to any one of claims 8, 9 or 11 further comprising a voltage source for applying to said developer carrying member a bias voltage for forming an alternating electric field in the developing zone.

13. A developing apparatus, comprising:

a container for containing a developer comprising toner particles having an average particles size 4–10 microns and magnetic carrier particles having an average particle size of 30–80 microns;

a rotatable stirring member for stirring the developer in said container, said rotatable member being supported by a bearing; and a magnet member enclosing at least a part of said rotatable member with a clearance therefrom which is larger than 10 times the average particle size of the magnetic carrier particles, at a position adjacent to the bearing, said magnet member being fixed on said container, and said magnet member being magnetized in a longitudinal direction of said rotatable member, wherein said rotatable member comprises a ferromagnetic material at least at a position facing said magnet member, wherein the ferromagnetic material is magnetized by said magnet member, wherein a magnetic field formed between said magnet member and the ferromagnetic material forms a magnetic brush of the developer between the magnet member and said rotatable member, and wherein the magnetic brush includes a portion rotating in accordance with rotation of said rotatable member and a portion substantially stationary by being confined on said magnet member.

14. An apparatus according to claim 13, further comprising a voltage source for applying to said developer carrying member a bias voltage for forming an alternating electric field in the developing zone.

15. An apparatus according to claim 13 or 14, wherein said magnet member provides a surface magnetic flux density of at least 600 Gauss.

16. An apparatus according to any one of claims 1, 6 or 13, wherein said ferromagnetic material comprises iron.

17. A developing apparatus comprising:

a container for containing a developer comprising magnetic particles;

a rotatable member rotatable in contact with the developer in said container, said rotatable member being supported in said container by a bearing;

a magnet member enclosing at least a part of said rotatable member at a position adjacent to the bearing;

wherein said rotatable member comprises a ferromagnetic material disposed at least at a position facing said magnet member;

wherein the ferromagnetic material is magnetized by said magnet member, wherein a magnetic field formed between said magnet member and the ferromagnetic material forms a magnetic brush of the developer between said magnet member and said rotatable member, wherein said rotatable member comprises a portion for stirring the developer; and a developer carrying member for carrying the developer stirred by said rotatable member to a developing zone for developing an electrostatic latent image and magnet means stationarily disposed inside of said developer carrying member, wherein the magnetic brush comprises a rotatable portion supported on said rotatable member and rotating in accordance with rotation of said rotatable member and a substantially stationary portion supported and confined by said fixed magnet member.

18. An apparatus according to claim 17, further comprising a voltage source for applying to said developer carrying member a bias voltage for forming an alternating electric field in the developing zone.

19. An apparatus according to claim 17, wherein a clearance between said magnet member and said rotatable member is larger than 10 times an average particle size of the magnetic carrier particles.

* * * * *

UNITED STATES PATENT AND TRADEMARK OFFICE

CERTIFICATE OF CORRECTION

PATENT NO. : 5,267,007

DATED : NOVEMBER 30, 1993

INVENTOR(S) : AKIRA WATANABE, ET AL.

It is certified that error appears in the above-indentified patent and that said Letters Patent is hereby corrected as shown below:

On the title page:

Item: [76]
Line Inventors, "all of c/o Canon Kabushiki Kaisha 3-30-2 Shimomaruko, Ohta-ku, Tokyo, Japan" should read --all of Yokohama, Japan--.

IN THE ASSIGNEE AT [73]
Insert: --[73] Assignee: Canon Kabushiki Kaisha, Tokyo, Japan--.

FOREIGN APPLICATION PRIORITY DATA AT [30]
"Dec. 28, 1989 [JP] Japan .... 10342440" should read --December 28, 1989 [JP] Japan .... 1-342440--.

IN THE REFRENCES CITED AT [56]
Foreign Patent Documents, "0219233 9/1986 European Pat. Off." should read --0219233 4/1987 European Pat. Off.--.

IN THE REFERENCES CITED at [56]
Insert after Assistant Examiner: --Attorney, Agent, or Firm-Fitzpatrick, Cella, Harper & Scinto--.

COLUMN 1
Line 18, "No. 0,219,233A" should read --No. 0219233A--.
Line 29, "No. 0,219,233A" should read --No. 0219233A--.

COLUMN 2
Line 20, "coagulate," should read --coagulates,--.
Line 32, "with" should be deleted.
Line 57, "No. 0,219,233A" should read --No. 0219233A--.

UNITED STATES PATENT AND TRADEMARK OFFICE

CERTIFICATE OF CORRECTION

PATENT NO. : 5,267,007

DATED : NOVEMBER 30, 1993

INVENTOR(S) : AKIRA WATANABE, ET AL.

It is certified that error appears in the above-indentified patent and that said Letters Patent is hereby corrected as shown below:

COLUMN 3

Line 31, "a" should be deleted.
Line 34, "a" should be deleted.

COLUMN 4

Line 22, "to" should read --top--.

COLUMN 5

Line 66, "position." should read --position, is limited--.

COLUMN 6

Line 26, "the an" should read --an--.
Line 27, "having" should read --has--.
Line 65, "an" should be deleted.

COLUMN 7

Line 12, "Callter" should read --Coulter--.
Line 13, "Callter" should read --Coulter--.

COLUMN 9

Line 28, "is" should read --are--.

COLUMN 10

Line 54, "is" should read --are--.

UNITED STATES PATENT AND TRADEMARK OFFICE

CERTIFICATE OF CORRECTION

PATENT NO. : 5,267,007

DATED : NOVEMBER 30, 1993

INVENTOR(S) : AKIRA WATANABE, ET AL.

It is certified that error appears in the above-indentified patent and that said Letters Patent is hereby corrected as shown below:

COLUMN 11
Line 42, "is" should read --are--.
Line 57, "is" should be deleted.

COLUMN 13
Line 17, "to" should be deleted.

COLUMN 14
Line 31, "is" should read --are--.

COLUMN 15
Line 9, "is" should read --are--.
Line 38, "sheet being" should read --sheet is being--.

COLUMN 16
Line 19, "wit" should read --with--.
Line 56, "according" should read --accordance--.

Signed and Sealed this

Sixth Day of September, 1994

*Attest:*

*Attesting Officer*

BRUCE LEHMAN

*Commissioner of Patents and Trademarks*